United States Patent [19]

Johannson

[11] 4,356,893

[45] Nov. 2, 1982

[54] LOAD LIFTING CARRIAGE AND MAST ASSEMBLY

[75] Inventor: Richard J. Johannson, Dallas, Oreg.

[73] Assignee: Towmotor Corporation, Mentor, Ohio

[21] Appl. No.: 151,842

[22] PCT Filed: Apr. 14, 1980

[86] PCT No.: PCT/US80/00413

§ 371 Date: Apr. 14, 1980

§ 102(e) Date: Apr. 14, 1980

[87] PCT Pub. No.: WO81/03014

PCT Pub. Date: Oct. 29, 1981

[51] Int. Cl.[3] ..... B66B 9/20

[52] U.S. Cl. ..... 187/9 E; 414/631

[58] Field of Search ..... 187/9 R, 9 E, 17; 414/629, 631, 641; 92/164, 146; 254/93 R

[56] References Cited

U.S. PATENT DOCUMENTS

| | | | |
|---|---|---|---|
| 2,653,678 | 9/1953 | Lehrman | 187/9 R |
| 2,821,264 | 1/1958 | Ulinski | 187/9 E |
| 2,925,887 | 2/1960 | Gibson | 187/9 E |
| 3,127,956 | 4/1964 | Hosbein et al. | 187/9 E |
| 3,208,556 | 9/1965 | Shaffer | 187/9 E |
| 3,394,778 | 7/1968 | Brinton | 187/9 E |
| 3,534,664 | 10/1970 | Ulinski | 187/9 E |

*Primary Examiner*—Joseph J. Rolla
*Assistant Examiner*—Kenneth Noland
*Attorney, Agent, or Firm*—Phillips, Moore, Weissenberger, Lempio & Majestic

[57] ABSTRACT

A carriage and mast assembly (10) including a mast (16) having outer sides (R, L) and a first pair (36, 38) of movable inner uprights and a second pair (20, 22) of fixed outer uprights, a load lifting carriage (12), a pair (48, 50) of free lift cylinders being directly connected to the first pair (36, 38) of uprights and to the load lifting carriage (12), a pair (52, 54) of mast lift cylinders being connected to the first pair (36, 38) of uprights and to the second pair (20, 22) of uprights, each pair (48, 50) (52, 54) of cylinders being disposed at the outer sides (R, L), and a pair of (98) of means for communicating fluid between one (50) of the free lift cylinders (48, 50) and one (54) of the mast lift cylinders (52, 54), respectively.

The invention relates to load lifting carriage and mast assemblies (10) having a free lift carriage (12). The problems of using lift chains and sheaves to free lift the carriage (12) and operator visibility through the mast (16) are avoided by directly connecting the free lift cylinders (48, 50) to the carriage (12) and mast (16) and disposing these cylinders (48, 50) outside the mast (16).

6 Claims, 11 Drawing Figures

FIGURE 3
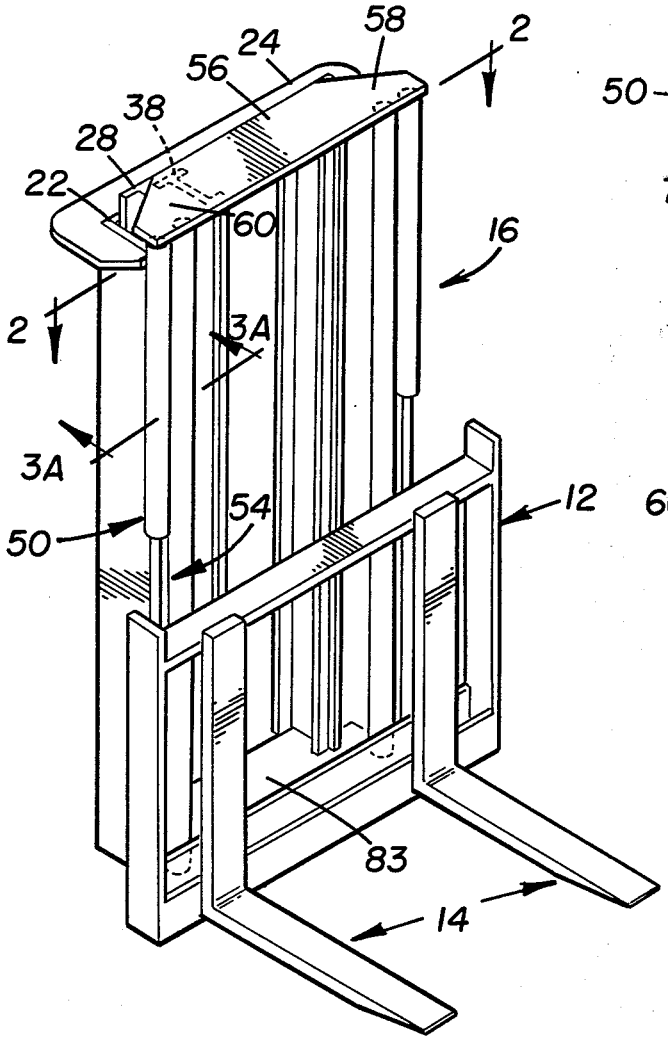
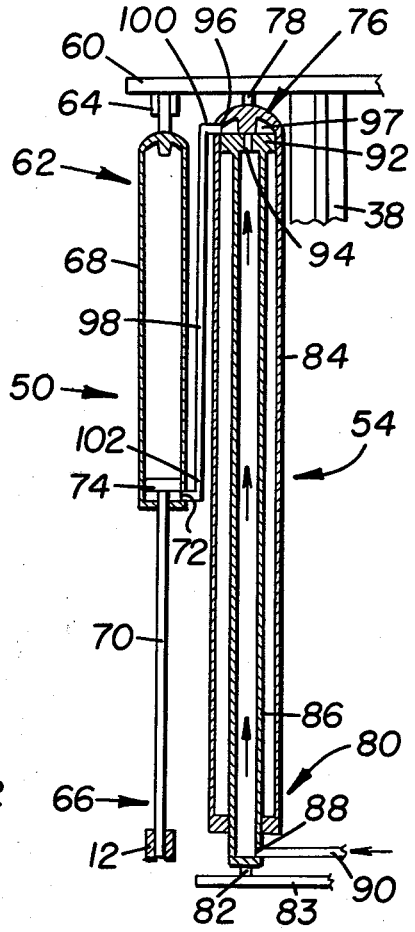
FIGURE 3A

LOAD LIFTING CARRIAGE AND MAST ASSEMBLY

TECHNICAL FIELD

This invention relates to load lifting apparatus and, more particularly, to a free lift carriage and mast assembly.

BACKGROUND ART

A carriage and mast assembly is commonly used on vehicles such as fork lift trucks to pick up and deliver loads from one area to another. The mast usually has a pair of movable inner uprights which can be raised vertically in relation to a pair of fixed outer uprights. In a carriage and mast assembly which has "free lift", the carriage is carried on the inner uprights and can be raised or lifted vertically without extending the inner uprights. Furthermore, after the carriage is fully lifted, the inner uprights and carriage can be raised in unison along the fixed outer uprights. The advantages of having these relative movements are well-known and need not be discussed further.

Free lift of the carriage is accomplished with prior carriage and mast assemblies by using lift cylinders and lift chains. For example, an assembly will include at least one lift cylinder having an outer jacket and a piston rod that can be extended from the jacket. At least one lift chain has one end coupled to the carriage and extends about a sheave connected to the piston rod, with the other end being fixed, for example, to the outer jacket. This lift chain provides an indirect coupling between the lift cylinder and carriage. When the piston rod is extended, the lift chain will move around the sheave and the carriage will be lifted with respect to the inner uprights to produce the free lift.

A disadvantage with prior free lift mechanisms is that the lift chains will wear over a period of use. This means that chain failure can occur and/or that the chains must be repaired or replaced. Also, the weight and cost of the carriage and mast assembly are undesirably increased due to the need for the lift chains, together with the mounting components such as the sheaves. Furthermore, during the lifting of the carriage or during movement of the lift truck, the lift chains can flap about, thereby marring or possibly damaging the lift cylinders.

Another disadvantage is that operator visibility is impaired with prior free lift mechanisms. Typically, the free lift cylinders and lift chains are disposed in the space between the inner uprights. The use of the lift chains, and/or this placement of the cylinders and chains, limits operator visibility through the mast.

Yet another disadvantage with prior free lift mechanisms is that the free lift cylinders are exposed to damage from objects near the floor. For example, in the lowered position, the carriage will be near the floor with the piston rod retracted into the cylinder jacket and the latter also located near the floor. The carriage, which is in front of the cylinder, can protect the cylinder from such objects. However, when the carriage is raised for free lift, the cylinder jacket is still near the floor and, thereby, exposed to damage from these objects. Furthermore, the carriage is normally loaded in the raised position, with the rod being extended from the jacket. This can cause the rod to bend.

The present invention is directed to overcoming one or more of the problems as set forth above.

DISCLOSURE OF THE INVENTION

In one aspect of the present invention, a lifting apparatus comprises first and second pairs of uprights movable relative to each other, a load lifting carriage, a pair of free lift cylinders each including a jacket connected to the first pair of uprights and a free lift piston rod connected to the carriage, a pair of mast lift cylinders each including a jacket connected to the first pair of uprights and a mast lift piston rod fixed to the second pair of uprights, and means for communicating fluid between the free lift cylinders and the mast lift cylinders.

Prior free lift carriage and mast assemblies utilize lift chains and lift cylinders which are disposed in the space between a pair of inner uprights. This will lead eventually to chain wear and failure, requiring repair or replacement, and will increase the weight and cost of the assembly, as well as decrease operator visibility. With the present invention, the free lift cylinder is directly connected between the pair of inner uprights and the carriage for free lift purposes. This eliminates the need for lift chains and can improve operator visibility by disposing the lift cylinder outside the pair of uprights. Furthermore, the cylinder can be connected to the mast and carriage so that in a raised free-lift position of the carriage, the cylinder rod is retracted into the cylinder jacket, whereby the cylinder is not exposed to damage from objects near the floor and there is less possibility the rod bending.

BRIEF DESCRIPTION OF THE DRAWINGS

FIG. 3 is a perspective view of the carriage and mast assembly of FIGS. 1 and 2 in a lowered position.

FIG. 3A is a front elevation taken along lines 3A—3A of FIG. 3.

BEST MODE FOR CARRYING OUT THE INVENTION

Figure 1:
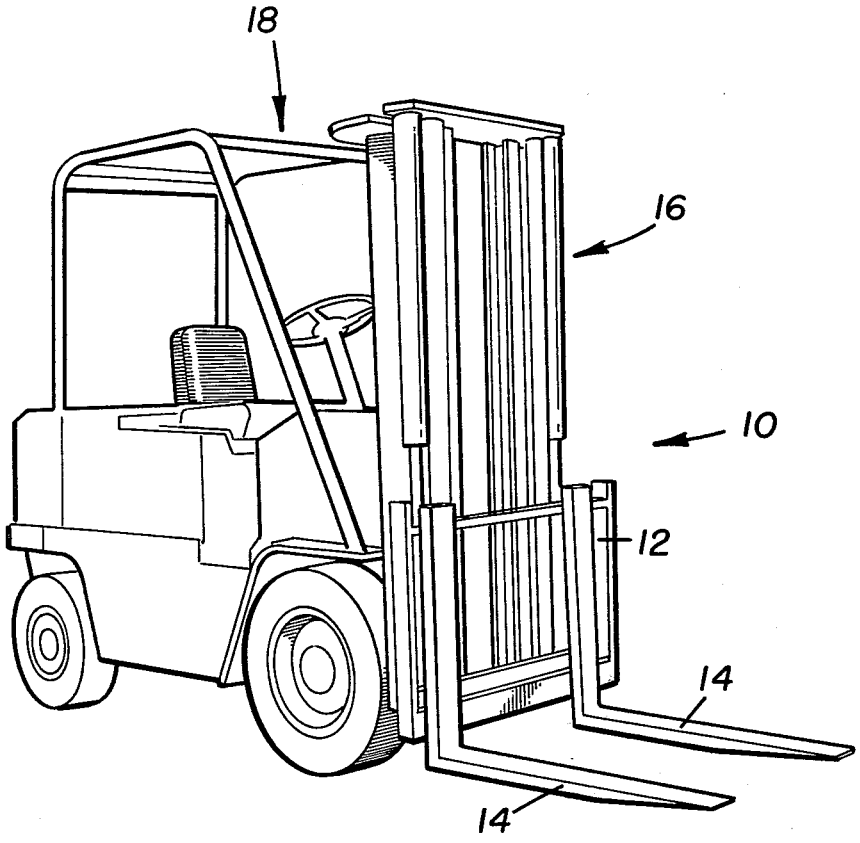
FIG. 1 is a perspective view of a lift truck having an embodiment of the present invention.

FIG. 1 shows a carriage and mast assembly 10 of the present invention. A carriage 12, particularly one having forks 14, is supported on a mast 16. The entire assembly 10 is supported on, for example, a lift truck 18 in a conventional manner.

Figure 2:
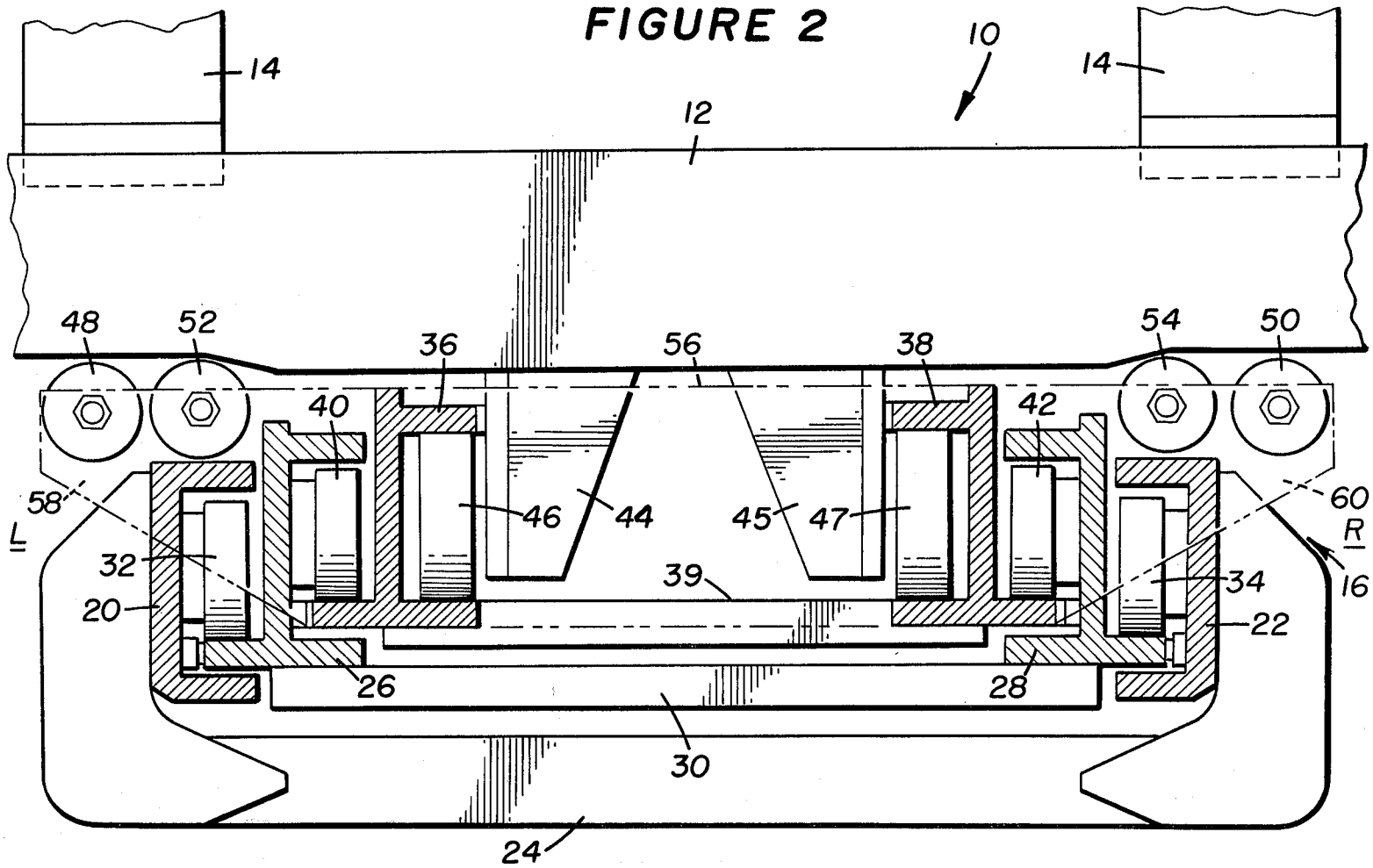
FIG. 2 is a section taken along lines 2—2 of FIG. 3.

As shown in FIG. 2, the mast 16 has a pair of fixed, U-shaped, outer uprights 20, 22 which are coupled together by a wrap-around tie bar 24. A pair of movable, J-shaped, intermediate uprights 26, 28 are partially nestled within the outer uprights 20, 22, respectively. A tie bar 30 couples the upright 26 to the upright 28. A pair of upper rollers 32, 34 are connected, respectively, to the outer uprights 20, 22, to roll on the intermediate uprights 26, 28, as shown. These rollers 32, 34 permit the intermediate uprights 26, 28 to move vertically in relation to the fixed uprights 20, 22.

A pair of movable, J-shaped, inner uprights 36, 38 are partially nestled within the intermediate uprights 26, 28, respectively. A tie bar 39 connects the upright 36 to the upright 38. A pair of upper rollers 40, 42 are coupled, respectively, to the uprights 26, 28 and roll on the inner uprights 36, 38, as shown. These rollers 40, 42 permit the inner uprights 36, 38 to move vertically in relation to the intermediate uprights 26, 28.

The carriage 12 has a pair of roller brackets 44, 45 that carry a pair of rollers 46, 47 which roll on the inner uprights 36, 38, respectively. Consequently, carriage 12 can move vertically in relation to the inner uprights 36, 38 to provide "free lift" capability. While FIG. 2 shows only pairs of upper rollers 32, 34, 40, 42, 46 and 47, the mast 16 and carriage 12 can have similar lower rollers (not shown) to aid in the vertical movements of the inner uprights 36, 38, the intermediate uprights 26, 28 and the carriage 12.

FIG. 2 also shows a pair of free lift cylinders 48, 50 and a pair of mast lift cylinders 52, 54. Cylinder 50 and cylinder 54 are disposed to the outer, right side R of the mast 16, while cylinder 48 and cylinder 52 are disposed to the outer, left side of L of the mast 16. As will be discussed below, since the free lift cylinders 48, 50 are not positioned in the space between the inner uprights 36, 38, operator visibility through the mast 16 is improved.

FIG. 3 shows generally the mast 16 having all the pairs of uprights shown in FIG. 2, and specifically the fixed outer upright 22, the intermediate upright 28 and the inner upright 38. A top cross member 56 is fixed to the top of the inner uprights 36, 38 and extends to the outer sides of the mast 16 as shown by extensions 58, 60, respectively (see also FIG. 2). The carriage 12 also is shown in FIG. 3.

With reference to FIG. 3 and FIG. 3A, the free lift cylinder 50 is fixedly connected at an upper end 62 to the extension 60 by a connector 64. Cylinder 50 has a lower end 66 fixed to the lower portion of carriage 12. More specifically, cylinder 50 has an outer jacket 68 fixed at the end 62 to the connector 64 and a piston rod 70 fixed at the end 66 to the carriage 12. The outer jacket 68 has a lower fluid input port 72 through which hydraulic fluid is received to act against a piston 74 connected to the top end of the rod 70. Thus, cylinder 50 is connected directly between the inner uprights 36, 38 and the carriage 12, i.e. without lift chains, sheaves, etc., to lift the carriage 12 as will be described.

The mast lift cylinder 54 is fixedly connected at an upper end 76 to the extension 60 by a connector 78, and is fixedly connected at a lower end 80 by a connector 82 to a cross member 83 interconnecting the lower ends of the outer uprights 20, 22. More specifically, cylinder 54 has an outer jacket 84 fixed at the upper end 76 to the connector 78 and a piston rod 86 fixed at the lower end 80 to the connector 82. Piston rod 86 is preferably tubular and has a fluid input port 888 at the lower end 80 connected to a hydraulic fluid conduit 90 which can be rigid or flexible. A piston 92 is connected to the top of rod 86 and has a fluid passage 94 which communicates fluid between the interior of rod 86 and an upper fluid output port 96 of the outer jacket 84 through a cylinder area 97. A rigid fluid conduit 98 has one end 100 coupled to the output port 96 of the mast lift cylinder 54 and another end 102 coupled to the input port 72 of the free lift cylinder 50. Fixed, elongated guards (not shown) are connected respectively between cylinder 50 and cylinder 54 and between cylinder 48 and cylinder 52 to protect cylinder 54 and cylinder 52 when the mast 16 is extended, as will become apparent in the discussion of FIG. 5 and FIG. 6.

Consequently, as shown by the arrows in FIG. 3A, hydraulic fluid can flow through the conduit 90 and input port 88 to the interior of piston rod 86. From rod 86, the fluid can flow through the passage 94, area 97, and output port 96 into the conduit 98 and free lift cylinder 50 via the input port 72. Free lift cylinder 50 and mast lift cylinder 54 are sized such that hydraulic fluid pressure first activates cylinder 50 by fully retracting the rod 70 to free lift the carriage 12 relative to the inner uprights 36, 38. Once the rod 70 is fully retracted, the pressure will increase in the cylinder 54, i.e., in the area 97, to raise the outer jacket 84 relative to hollow rod 86, thereby raising the inner uprights 36, 38, cylinder 50 and carriage 12. While not shown, free lift cylinder 48 and mast lift cylinder 52 are similarly connected to the mast 16 and carriage 12, and hydraulically coupled to each other, as illustrated in FIG. 3A.

Figure 7:
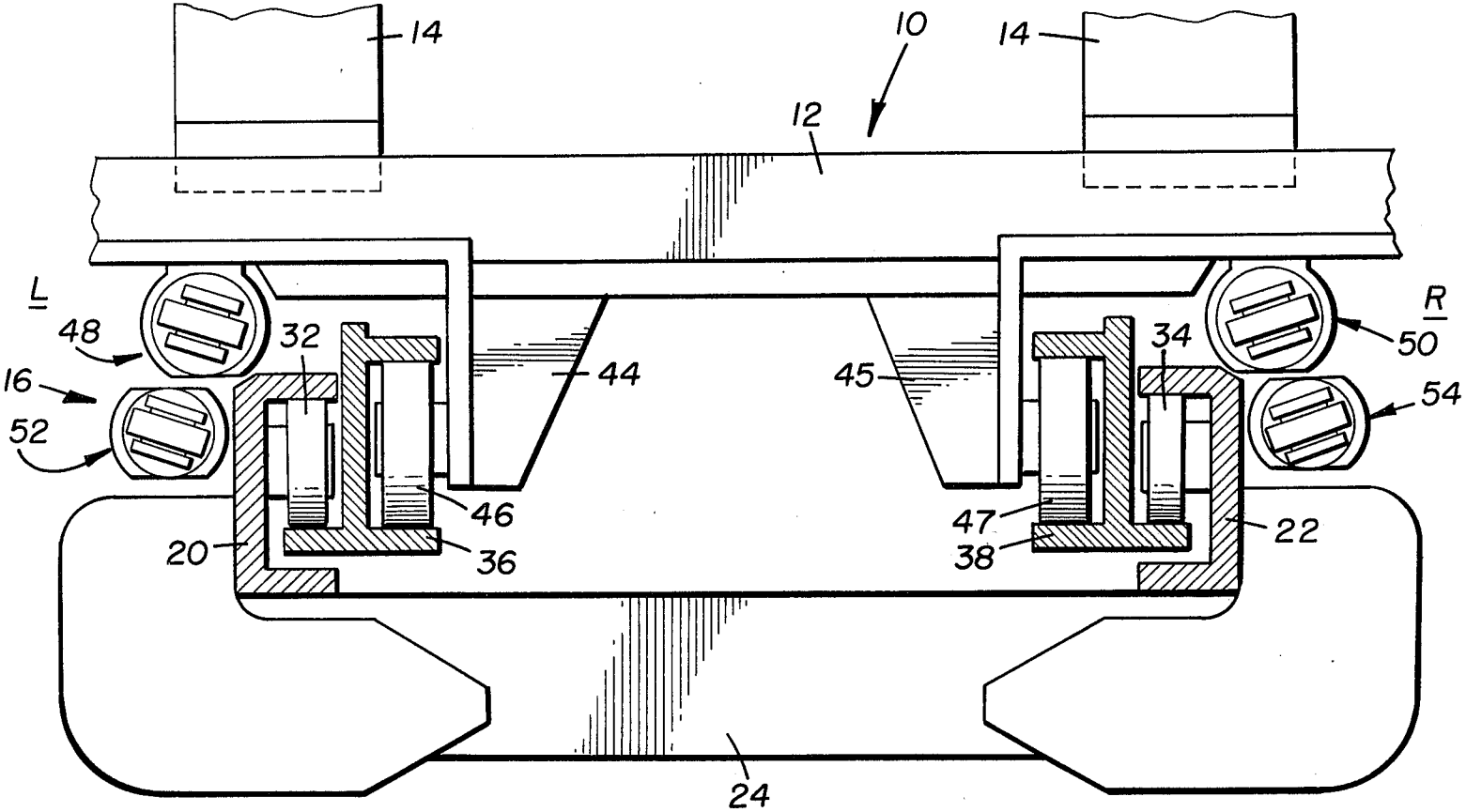
FIG. 7 is a section similar to FIG. 2 and showing an alternative embodiment of the present invention.

FIG. 7 shows an alternative embodiment of the cylinder and mast assembly 10. The mast 16, rather than having three pairs of uprights as shown in the embodiment of FIG. 2, has two pairs of uprights including the fixed outer pair 20, 22 and the movable inner pair of uprights 36, 38. The wrap-around tie bar 24 connects the upright 20 to the upright 22. The roller 32 and roller 34 are connected, respectively, to the upright 20 and upright 22 to permit the inner uprights 36, 38 to move vertically in relation to the outer uprights 20, 22. Similarly, roller 46 and roller 47 are connected, respectively, to roller bracket 44 and roller bracket 45 of the carriage 12 to permit the carriage 12 to move vertically in relation to the inner uprights 36, 38 for free lift purposes.

FIG. 7 also shows the pair of free lift cylinders 48, 50 and the pair of mast lift cylinders 52, 54. Unlike the side-to-side positioning of these cylinders as shown in FIG. 2, the cylinder 52 is positioned behind and slightly to the left of the cylinder 48, while the cylinder 54 is positioned behind and slightly to the right of cylinder 50. The cylinders 48 and 52 are disposed to the left side L of the mast 16 and the cylinders 50 and 54 are disposed to the right side R of the mast 16 so that operator visibility through the mast 16 is not obstructed by these cylinders, similarly as in the FIG. 2 embodiment. The embodiment of FIG. 7 also offers greater operator visibility towards the outer side L and outer side R over the FIG. 2 embodiment since the mast lift cylinders 52, 54 are disposed closer in towards the mast center. While not shown in FIG. 7, the cylinders 48, 52 and cylinders 50, 54 are connected to the mast 16 and carriage 12, and are hydraulically coupled to one another in the same manner as shown in FIG. 3A.

While also not shown, yet another embodiment of the invention would consist of only a single free lift cylinder 50 and a single mast lift cylinder 54 disposed midway between the inner uprights 36, 38. The cylinder 50 and cylinder 54 would be connected between the carriage 12 and mast 16 and hydraulically coupled to each other as already described, with cylinder 54 being disposed behind cylinder 50. This embodiment, though, would reduce operator visibility through the mast 16 in relation to the embodiments of FIG. 2 and FIG. 7. However, increased operator visibility through the mast 16 is obtained in relation to prior free lift mechanisms since no lift chains are required.

INDUSTRIAL APPLICABILITY

As indicated above, the carriage and mast assembly 10 can be connected to a fork lift truck 18 which is used to pick up a load at one area and deliver the load to another area. The operation of the assembly 10 is illustrated in FIGS. 3-6 and FIGS. 3A-6A.

FIG. 3 and FIG. 3A illustrate the lowered position of the carriage 12 and mast 16. In this lowered position, the forks 14 of the carriage 12 are adjacent a floor with the piston rod 70 being fully extended from the outer jacket 68 of the cylinder 50, and the piston rod 86 being fully withdrawn in the outer jacket 84 of the cylinder 54. Also, the pair of inner uprights 36, 38 and pair of intermediate uprights 26, 28 are in their lowered position.

In this lowered position, the forks 14 can be moved by the lift truck 18 beneath a load. Then, to produce free lift of the carriage 12, i.e., to lift the carriage 12 without raising the uprights of the mast 16, hydraulic fluid is introduced into the piston rod 86 from the conduit 90. The fluid then flows through the piston passage 94, out the port 96 and into the conduit 98 where the fluid then flows into the cylinder 50 via the port 72 to act on piston 74. Consequently, the piston rod 70 is retracted into the outer jacket 68 to lift the carriage 12 and forks 14. At the end of the stroke, the carriage 12 has been lifted to the full free lift position shown in FIG. 4 and FIG. 4A.

Thereafter, to lift the inner uprights 36, 38 in relation to the intermediate uprights 26, 28, fluid continues to be introduced into the piston rod 86. Since the piston rod 70 has been retracted its full stroke, fluid pressure begins to rise in the area 97 of the cylinder 54. This fluid pressure causes the outer jacket 84 of the cylinder 54 to be raised in relation to the piston rod 86. As a result, the top cross member 56 begins to rise and to carry with it the inner uprights 36, 38, the cylinder 50 and the carriage 12.

Figure 5:
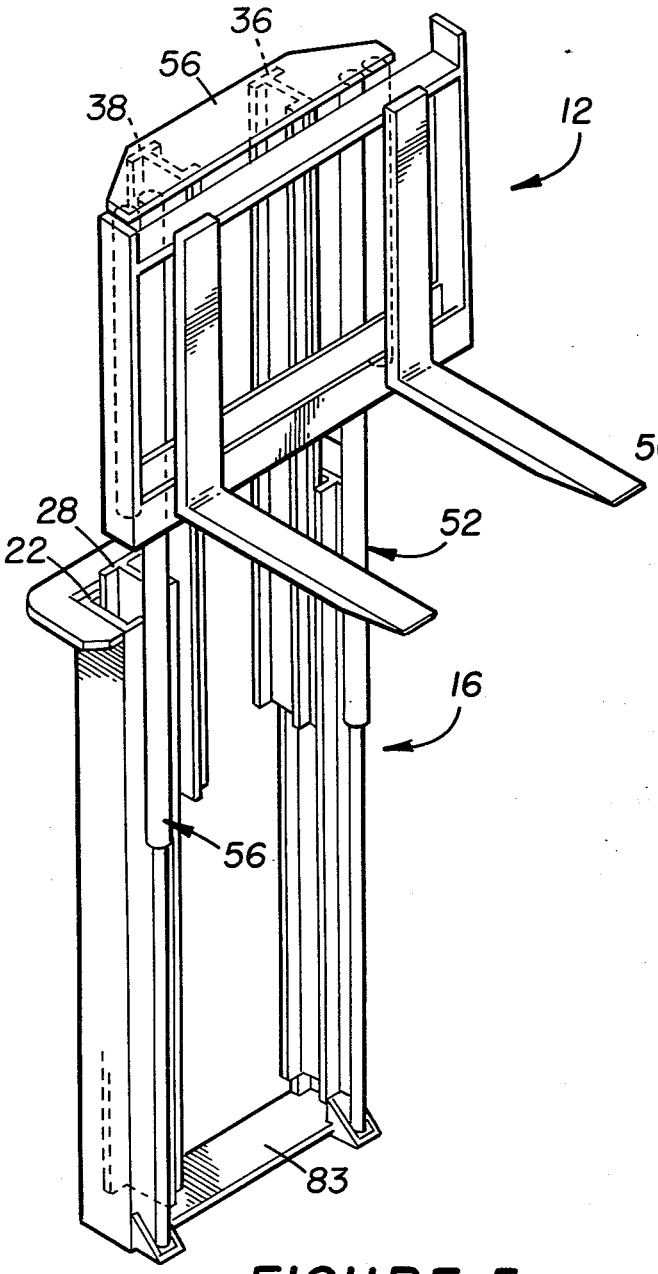
Figure 5A:
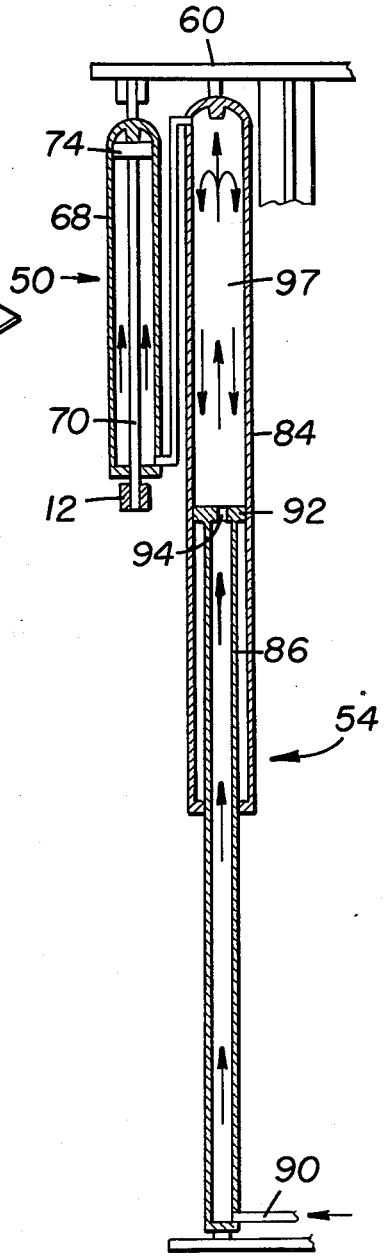
Figure 6:
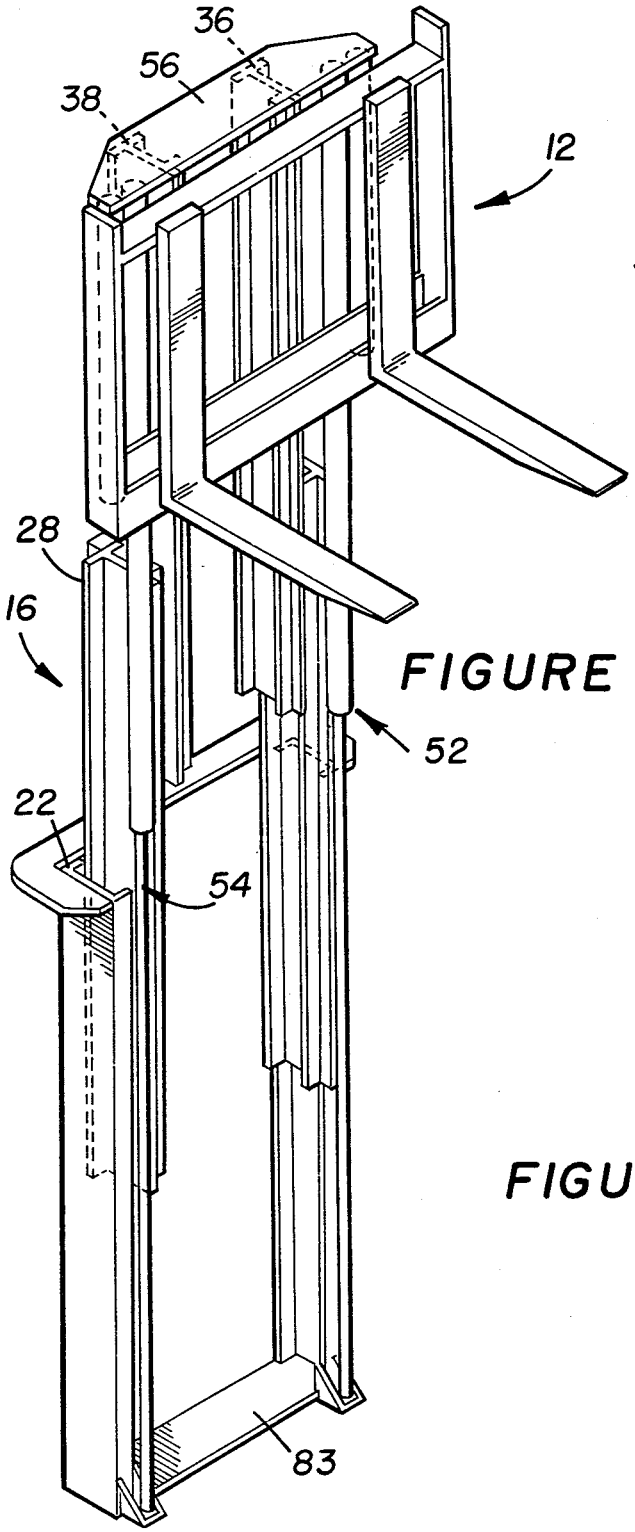
Figure 6A:
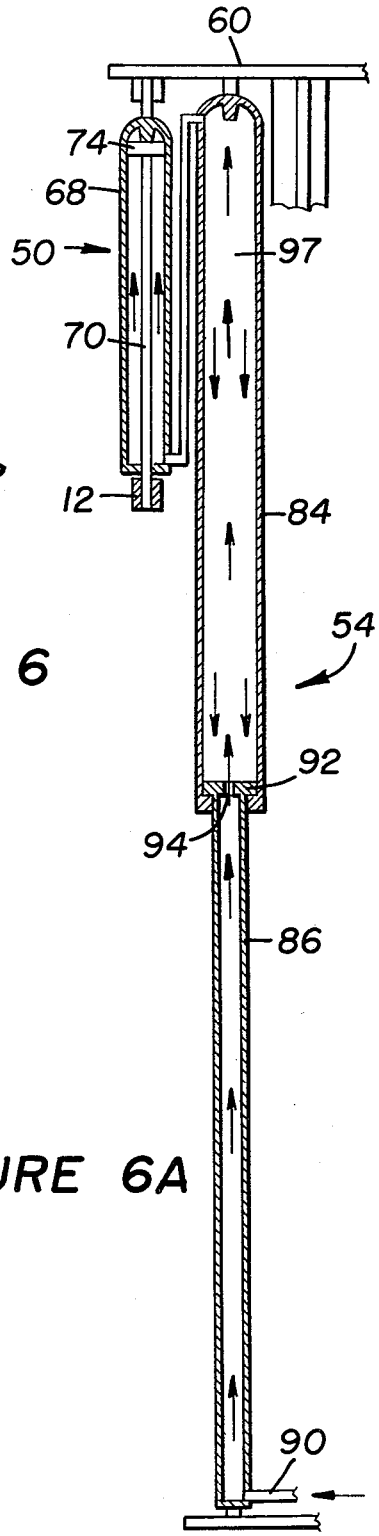

As this movement occurs, the assembly 10 reaches an intermediate position shown in FIG. 5 and FIG. 5A. At this intermediate position, the inner uprights 36, 38 engage conventional stops (not shown) on the intermediate uprights 26, 28. Thereafter, to raise the intermediate uprights 26, 28 in relation to the fixed outer uprights 20, 22, fluid continues to be introduced into the cylinder 54. As a result, the outer jacket 84 of the cylinder 54 continues to rise from the FIG. 5 and FIG. 5A position. Consequently, the inner uprights 36, 38 raise the intermediate uprights 26, 28, via the above-mentioned stops, in relation to the outer uprights 20, 22. FIG. 6 and FIG. 6A illustrate the final or fully extended position of the assembly 10.

Note that the raising of the carriage 12 to a free-lift position and then the raising of the inner uprights 36, 38 and intermediate uprights 26, 28 occur in response to different movements of, for example, cylinder 50 and cylinder 54. That is, cylinder 50 is retracted in that rod 70 is retracted into jacket 68 while cylinder 54 is extended in that jacket 84 is extended from rod 86.

When fluid is withdrawn from the cylinder 54 and cylinder 50 in the FIG. 6A position, the reverse sequence of operation will occur. That is, first the cylinder 54 will return to the FIG. 5A position and then the FIG. 4A position to lower the mast 16, and then cylinder 50 will return to the FIG. 3A position from the FIG. 4A position.

In summary, the present invention eliminates the need for lift chains, sheaves, etc. by directly connecting the free lift cylinders 48, 50 to the inner uprights 36, 38 and carriage 12. Operator visibility through the mast 16, i.e., between the inner uprights 36, 38, is improved by positioning all the cylinders at the outer sides of the mast 16.

Also, the cylinders 48, 50 are continually protected from damage due to objects near the floor. In the FIG. 3 and FIG. 3A position, the carriage 12 protects extended rod 70, while in the FIG. 4 and FIG. 4A position, neither the rod 70 nor the outer jacket 68 of cylinder 50 is near the floor.

Figure 4:
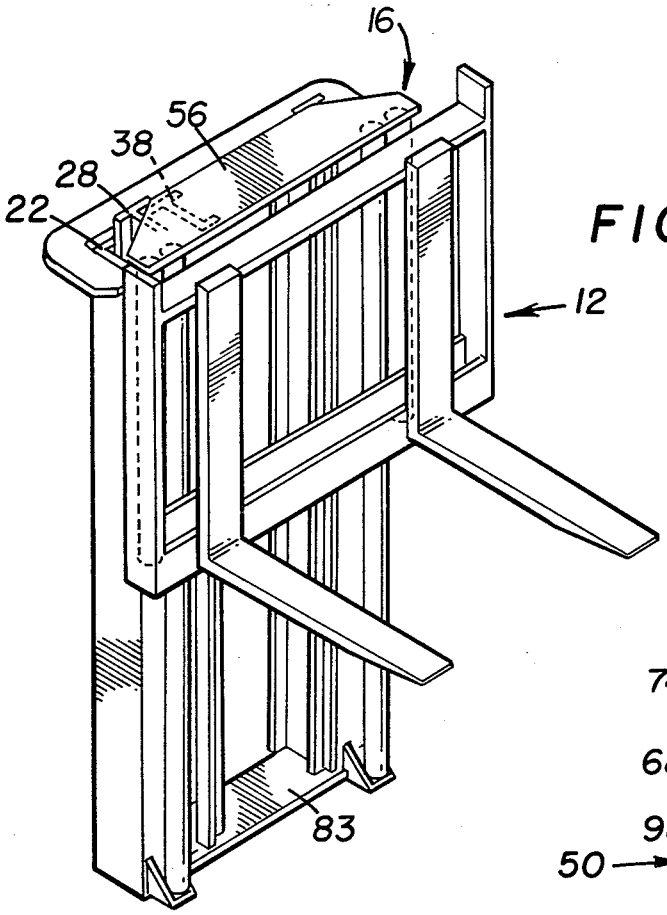
FIGS. 4–6 and FIGS. 4A–6A are views, similar to FIG. 3 and FIG. 3A, respectively, showing the sequence of operation and various positions of the carriage and mast assembly of the present invention.
Figure 4A:
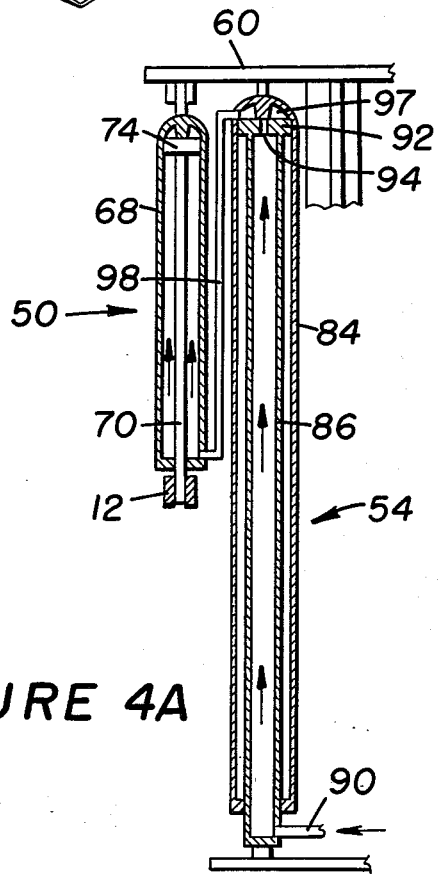

Furthermore, in the FIG. 4 and FIG. 4A position the rod 70 is retracted into the jacket 68 and it is in this carriage position that a load normally is carried. Since the rod 70 is retracted, there is less likelihood of the rod being bent than if the rod 70 were in an extended position. This also increases operator visibility through the mast and towards the floor.

Other aspects, objects and advantages of this invention can be obtained from a study of the drawings, the disclosure, and the appended claims.

I claim:

1. An apparatus (10) for lifting a load, comprising:

(a) a mast (16) having outer sides (R, L) and having a first pair (36, 38) of uprights and a second pair (20, 22) of uprights, said first pair (36, 38) being movable relative to said second pair (20, 22);

(b) a load lifting carriage (12);

(c) a pair (48, 50) of free lift cylinders, each of said free lift cylinders (48, 50) including a jacket (68) connected to said first pair (36, 38) of uprights and a free lift piston rod (70) connected to said carriage (12);

(d) a pair (52, 54) of mast lift cylinders, each of said mast lift cylinders (52, 54) including a jacket (84) connected to said first pair (36, 38) of uprights and a mast lift piston rod (86) fixed to said second pair (20, 22) of uprights; and (e) first and second means (98) for communicating fluid between one of said free lift cylinders (48, 50) and one of said mast lift cylinders (52, 54), respectively.

2. Apparatus (10) according to claim 1 wherein said pair (48, 50) of free lift cylinders and said pair (52, 54) of mast lift cylinders are positioned at said outer sides (R, L).

3. Apparatus (10) according to claim 1 wherein said jacket (68) of each of said free lift cylinders (48, 50) includes a fluid input port (72) and said jacket (84) of each of said mast lift cylinders (52, 54) includes a fluid output port (96), and wherein each of said first and second fluid communicating means (98) includes a fluid conduit (98) being connected to said input port (72) and said output port (96).

4. Apparatus (10) according to claim 3 wherein said mast lift piston rod (86) is hollow and includes a fixed lower end (80) having a fluid input port (88) and an upper end (76) having a piston (92) having a fluid passage (94) communicating the interior of said hollow rod (86) with said output port (96).

5. A carriage and mast assembly (10), comprising:

(a) a lift mast (16) having outer sides (R, L), and having first (36) and second (38) movable inner uprights, first (26) and second (28) movable intermediate uprights, and first (20) and second (22) fixed outer uprights, said first inner (36), intermediate (26) and outer (20) uprights being nestled in one another, and said second inner (38), intermediate (28) and outer (22) uprights being nestled in one another;

(b) a load carrying carriage (12);

(c) first (48) and second (50) cylinder means for free lifting said carriage (12), each being positioned at the outer sides (R, L) of said mast (16), respectively, and each including a jacket (68) having an upper end being connected to said first (36) and second (38) inner uprights and a lower end having a fluid input port (72), and a piston rod (70) having a lower end being connected to said carriage (12);

(d) first (52) and second (54) cylinder means for extending said first (36) and second (38) inner uprights relative to said first (26) and second (28) intermediate uprights and said first (26) and second (28) intermediate uprights relative to said first (20) and second (22) outer uprights, each being positioned at the outer sides (R, L) of said mast (16), respectively, and each including a jacket (84) having an upper end having a fluid output port (96) and being connected to said first (36) and second (38) inner uprights, and a hollow piston rod (86) having a fixed lower end having a fluid input port (88) and an upper end having a piston (92) having a fluid passage (94); and (e) first (98, 100, 102) and second (98, 100, 102) means for communicating fluid between said first (48) free lifting cylinder means and said first (52) extending cylinder means and between said second (50) free lifting cylinder means and said second (54) extending cylinder means, respectively, each including a rigid fluid conduit (98) having one end (102) being connected to said input port (72) of said jacket (68) and another end (100) being connected to said output port (96) of said jacket (84).

6. A carrige and mast assembly (10), comprising:

(a) a lift mast (16) having outer sides (R, L), and having first (36) and second (38) movable inner uprights and first (20) and second (22) fixed outer uprights, said first inner (36) and outer (20) uprights being nestled in one another, and said second inner (38) and outer (22) uprights being nestled in one another;

(b) a load carrying carriage (12);

(c) first (48) and second (50) cylinder means for free lifting said carriage (12), each being positioned at the outer sides (R, L) of said mast (16), respectively, and each including a jacket (68) having an upper end being connected to said first (36) and second (38) inner uprights and a lower end having a fluid input port (72), and a piston rod (70) having a lower end being connected to said carriage (12);

(d) first (52) and second (54) cylinder means for extending said first (36) and second (38) inner uprights relative to said first (20) and second (22) outer uprights, each being positioned at the outer sides (R, L) of said mast (16), respectively, and each including a jacket (84) having an upper end having a fluid output port (96) and being connected to said first (36) and second (38) inner uprights, and a hollow piston rod (86) having a fixed lower end having a fluid input port (88) and an upper end having a piston (92) having a fluid passage (94); and (e) first (98, 100, 102) and second (98, 100, 102) means for communicating fluid between said first (48) free lifting cylinder means and said first (52) extending cylinder means and between said second (50) free lifting cylinder means and said second (54) extending cylinder means, respectively, each including a rigid fluid conduit (98) having one end (102) being connected to said input port (72) of said jacket (68) and another end (100) being connected to said output port (96) of said jacket (84).

* * * * *